United States Patent [19]

von Ronai-Horvath et al.

[11] Patent Number: 4,501,114

[45] Date of Patent: Feb. 26, 1985

[54] APPARATUS FOR CONTROLLING PASSAGE OF MATERIAL THROUGH TEXTILE SPINNING OR TWISTING MACHINE

[75] Inventors: Michael von Ronai-Horvath, Ludwigsburg; Bernhard Schönung, Filderstadt, both of Fed. Rep. of Germany

[73] Assignee: SKF Kugellagerfabriken GmbH, Schweinfurt, Fed. Rep. of Germany

[21] Appl. No.: 387,193

[22] Filed: Jun. 10, 1982

[30] Foreign Application Priority Data

Jun. 13, 1981 [DE] Fed. Rep. of Germany ..... 3123476

[51] Int. Cl.[3] ..... D01H 13/16

[52] U.S. Cl. ..... 57/81; 57/86

[58] Field of Search ..... 57/78, 80, 81, 84, 86, 57/87

[56] References Cited

U.S. PATENT DOCUMENTS

| | | | |
|---|---|---|---|
| 3,158,852 | 11/1964 | Schachek | 57/81 X |
| 3,626,680 | 12/1971 | Whitney | 57/86 X |
| 3,751,896 | 8/1973 | Ford | 57/87 |
| 3,840,869 | 10/1974 | Pugh | 57/81 X |
| 4,160,360 | 7/1979 | Carvalho et al. | 57/81 |
| 4,263,776 | 4/1981 | Lane | 57/87 |
| 4,280,321 | 7/1981 | Marzoci | 57/81 |
| 4,311,916 | 1/1982 | Schenkel | 57/81 X |
| 4,330,094 | 5/1982 | Mayer | 57/81 X |

*Primary Examiner*—John Petrakes

*Attorney, Agent, or Firm*—Murray Schaffer

[57] ABSTRACT

The passage of material through a textile spinning or twisting machine is regulated through operation of a control element associated with the movement of said material. Light reflected from the moving material is converted into a variable electrical signal which is then modulated and used to operate a light-emitter. The modulated output of the light-emitter is sensed by a receiver located remote therefrom, but in direct-line-of sight, into an electrical command signal for operating the control element.

13 Claims, 6 Drawing Figures

APPARATUS FOR CONTROLLING PASSAGE OF MATERIAL THROUGH TEXTILE SPINNING OR TWISTING MACHINE

BACKGROUND OF THE INVENTION

The present invention relates to apparatus for arresting and controlling the operation of the draw frame of a textile spinning machine.

In (DE-OS No. 24 50 207), a sensor is assigned to monitor the finished yarn and comprises a light source and a light-sensitive cell providing an alternating light intensity signal, the absence of which is utilized to generate an actuating pulse for an arresting mechanism. The light source and the lighe-sensitive cell are arranged diametrically to each other on the inside wall of an annular yarn guide within which the running thread moves. The light-sensitive cell is connected by cable to an amplifier circuit arranged downstream from the latter, which in turn is connected by cable to a relay actuating the arresting mechanism. This cable connection, required between the sensor and the associated arresting mechanism, which is arranged at a distance from the former, cannot be established in practical application, in the shortest distance possible, in all types of machines because moving or adjustable machine parts or sheets of material exist and interfere with the direct wiring area. This is especially the case if the work site to be shut down is the spinning site of a ring spinning frame equipped with a draw frame.

It is also known (DE-OS No. 22 23 638) to provide a solenoid operated locking device for the slubbing running into the draw frame. The stop command for this locking device is given by a sensor which monitors the fiber bundle leaving the draw frame and which provides a switching signal for the locking device in case of yarn breakage. The difficulties mentioned above, nevertheless, continue to exist, since a cable connection is still necessary between the sensor and the solenoid. It is necessary for this reason to arrange the sensor at the front end of the machine with the solenoid by means of a cable laid along the front and then back around one front face in the interior of the machine. Since each machine has many work sites on draw frames, a multitude of connections must be made on the machine. This results in the use of a multi-core harness and high assembly costs, especially when the machine is to be equipped later on with a locking device.

It is also known (DE-OS No. 27 02 745) to separate the slubbing running into the draw frame of a spinning machine by means of a cutting device in the event of yarn breakage. Here, a sensor and a separating device are arranged on a carriage traversing the spinning sites, so that yarn breakage is recognized only when the carriage passes a respective spinning site. Since the yarn break may have been caused long before the carriage reaches the site, lap formation of the slubbing may have occurred with continued running into the draw frame. The arrangement of the sensor and separating device on an expensive carriage arrangement is justifiable only if the carriage bears in addition a threadspreader. In that case, however, the carriage is adapted exactly to the special spinning machine and is unsuited for use with other machines.

The present invention has as its object the creation of means for actuating in a simple and reliable manner a blocking or separating device assigned to the feed material at a fixed site remote from a sensor which may be assigned to the furnished material, without being subjected to restrictions with respect to the kind of material to be monitored and without having high cost regarding its assembly or functional connection, even with a relatively great distance between the sensor and the blocking or separating device.

These and other objects and advantages are set forth and are apparent from the following disclosure of the present invention.

SUMMARY OF THE INVENTION

The passage of material through a textile spinning or twisting machine passes, by means of known feed mechanisms, through or in contact with a control element which is capable of arresting the movement of the material by either blocking or separating the material from its feed mechanism. According to the present invention, each material so fed is provided with a system wherein light effected from the moving material is sensed and converted into an alternating electrical signal which is fed to a separate light emitter, such as a light-emitting diode, the electrical signal modulating the light emission. This modulated light emission is sensed by a remotely positioned receiver, arranged in a direct line of sight and converted into an electrical signal, the absence of which provides the command signal for actuating the control element to arrest the movement of the material. (Conversely, the presence of the material signal maintains the control element in inoperative function).

Since the stop command from the emitter is transmitted optically, only visual contact has to be established between the emitter and the receiver and the receiver may be arranged at another site in the machine. Because the stop command is transmitted by a modulated radiation beam, it is assured that other prevailing effects of light and artifical light, or the like, will not interfere with the transmission, for it is possible to place the modulation in a range outside of potentially interferring radiation. Control elements for blocking or separating the material may be assigned to each path of material, fed to the machine, making it possible to block or separate one or more or even all the material running into the machine immediately upon the disruption of the running of any one of the materials.

The present invention is particularly adaptable to yarn spinning and twisting machines wherein the finished yarn passes through a guide and is wound on a bobbin, while undergoing a ballooning action.

Obtaining an alternating light intensity signal for modulating the emitter from a ballooning thread is especially advantageous because the light portion reflected by the rotating balloon of thread generates an alternating current of such high frequency that it lies far above the range of other potential light interference sources, for instance room illumination by neon light.

In a machine in which more than one starting material is processed into a single finished end material, for instance a twisting machine in which three feed threads are combined into a twisted yarn, several sensor systems may be employed. It is especially advantageous in this case to transmit the alternating current, resulting from the modulated radiations of all the sensors assigned to the individual materials, to a common identification circuit which delivers the actuating pulse to one or all of the associated control means for blocking and/or separating the materials from their respective feed means.

In a machine processing only two starting materials into a single end material, for example in the manufacture of a core yarn, the use of the system for one material to control the operation of the other material can be advantageously effected because the sensors assigned to the starting materials and to the end material can be arranged with their associated control devices relative to one another in such a manner that they cross-control each other. The radiation beam of the sensor assigned to one material is picked up by the light-sensitive receiver assigned to another material, leading with appropriate light output directly to the actuating command for this material. Cable connections between the devices assigned to the individual materials are therefore not required.

According to the present invention, delay means may be provided in a control circuit leading to the advantage that an accidental short-term interruption of the light connection existing between the modulated light source of the sensor and the light-sensitive receiver such as may occur during cleaning, spreading of the thread or other manipulation by the operator in this area, will not immediately cause the actuation of the blocking or separating device. A time delay constant of about 5 seconds between the actuating command and the pulse delivered for the actuation of the blocking or separating device will not cause disruptions in other areas of the machine, even if an actually occurring disruption of the movement of the material has been ascertained.

Two functionally matched structural systems can be mounted to the respective machine independently of each other and may be brought into optical contact with each other. This makes it possible, without complex mounting measures, to use the device with machines of the most varied design and function and to retrofit already operational machines with sensors and associated blocking or separating devices. The required current for the two structural groups can be supplied by electric lines to be wired on the machine and shared by the former, to which the structural groups are individually connected, for instance by means of plugs.

Full details of the present invention are set forth in the following description and are illustrated in the accompanying drawings.

DESCRIPTION OF THE INVENTION

Figure 1:
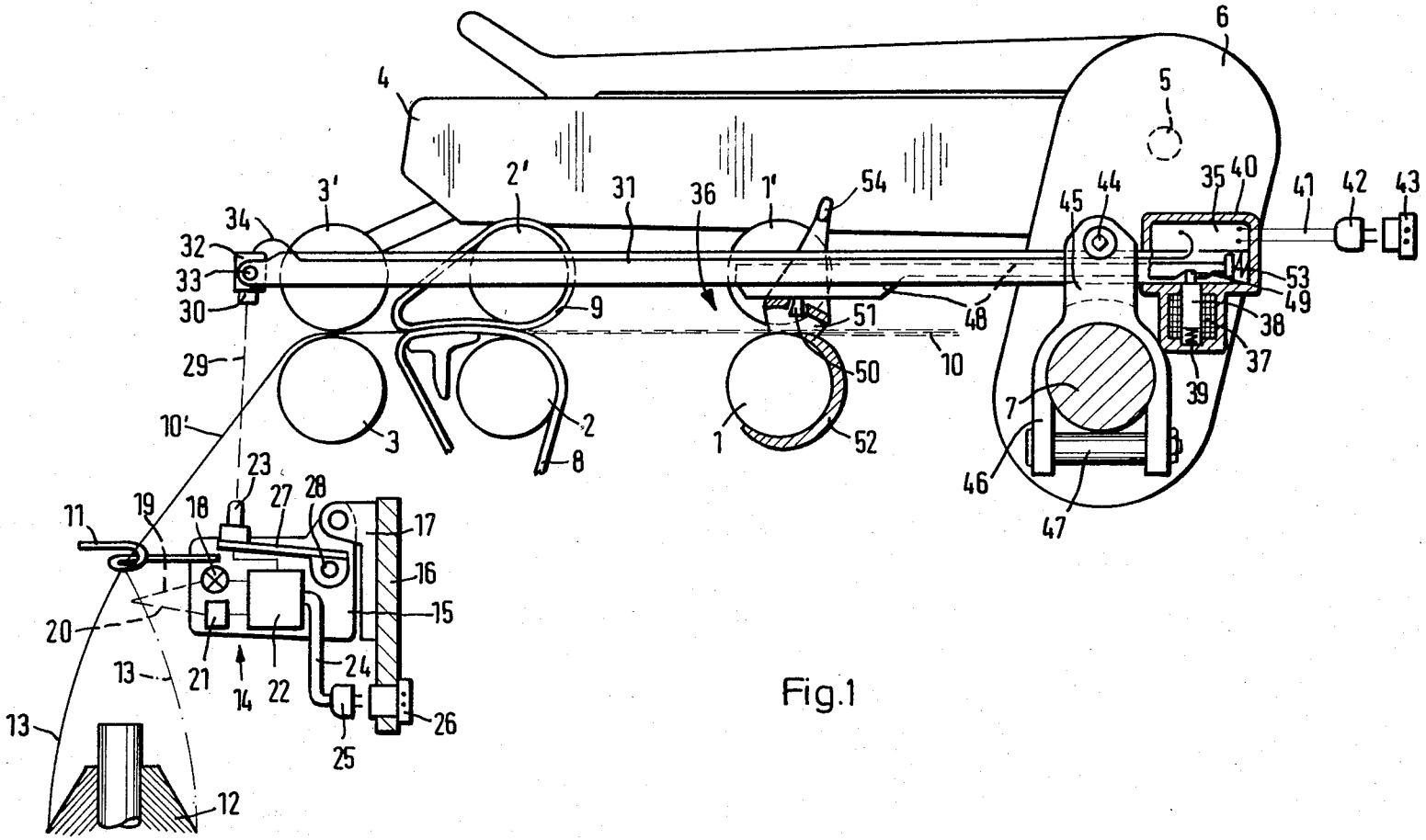
FIG. 1 is a side elevational view of a drawing frame illustrating the application thereto of the present invention.

In all of the following examples, while the starting material is a slubbing passing through a draw frame, the practical application of the process and device pursuant to the present invention is not limited to machines employing draw frames, but they may easily be applied also with other machines in which a continuous and/or staple fiber material is processed.

Turning now to the figures, a draw frame of conventional construction is illustrated, formed by driven lower rollers 1, 2 and 3 and upper rollers 1', 2', and 3' resting freely on top of them. The upper rollers are held in a support and load arm 4, which is mounted to be swivable upward, in a bearing 5 of a support bracket 6. The support bracket 6 is fastened on a rod 7 extending along the length of the machine. Rollers 2 and 2' are respectively provided with endless belts 8 and 9, the lower one of which runs over a curved pallette which defines the run of the belt.

A slubbing 10 is fed into the draw frame between the rollers 1, 2 and 3, and 1', 2', 3', and is stretched to form a fiber bundle 10' exiting from the pair of rollers 3, 3' for delivery to a yarn guide 11 arranged coaxially in relation to a spindle on which is mounted a cop or bobbin 12. The finished yarn 10' is wound on to the bobbin during which time a balloon of thread develops between the yarn guide 11 and the bobbin generally denoted by the numeral 13. The yarn guide 11 is part of a housing 15. The housing 15 is attached, to be swivable upward, on one of the walls 16 of the machine, by a hinge mounting 17.

According to the present invention, there is mounted on the housing 15 a sensor assembly generally depicted by the muneral 14. The sensor assembly comprises a light source 18 such as a fiber optic device or light-emitting diode, having its rays bundled or concentrated into a beam 19, directed onto the thread bundle 10', and specifically to intersect the area lying in running direction behind (i.e. below) the yarn guide 11 so the ballooning thread passes rapidly through the light beam 19 so that its rays are reflected by the moving thread 13. The reflected rays 20 are received by light-sensitive cell 21 as an alternating light intensity signal. The cell 21 produces an alternating electric output signal which is then fed to a modulating pulse generating circuit 22 arranged downstream thereof, which powers a second light-emitting diode 23. The current for the electrical components is supplied through a cable 24 having a plug 25 connected to a power source line 26 wired alongside the machine.

The light-emitting diode 23 produces a modulated beam according to the alternating light intensity signal as altered by the circuit 22 and is arranged so as to project from the housing 15 to which it is fastened by an adjustable mounting 27, as indicated by the pivot bearing 28. In lieu of this pivot bearing 28, the mounting 27 can be arranged in a ball joint permitting universal adjustment. Through this adjustability of the light-emitting diode 23, its modulated luminous radiation beam 29, which is also concentrated by an optical device such as a lens or prism, is directed to a light-sensitive photo receiver 30 which may be arranged at a selected site of the machine and separated by a space from the light-emitting diode 23.

In the example according to FIG. 1 this light-sensitive receiver 30 is mounted on an inverted-U-shaped bearing rail 31, arranged alongside the support and load arm 4, and specifically at the forward end of this bearing rail 31 next to the exit of the drawing frame. The receiver 30 is mounted in a housing 32 which is itself adjustable relative to the bearing rail 31, for instance in a pivot bearing 33. In lieu thereof, a ball joint mounting may be provided by which the housing 32 may be more easily aligned with the light-emitting diode 23. The photo receiver 30, in response to the modulated luminous radiation beam 29 produces an equivalent alternating voltage delivered by way of a line 34 to an amplifier and subsequently to an identification circuit, designated collectively by the numeral 35. The identification circuit is constructed in such a manner that it will trigger an actuating pulse for a blocking device for the slubbing 10 generally denoted by 36, when the alternating voltage is absent. This alternating pulse is a surge of current exciting the solenoid electromagnet 37 causing core 38 to be retracted against the force of a compression spring 39.

The amplifier and the identification circuit 35 which are preferably arranged on a pallette or circuit board, are inserted in a housing 40 accommodating also the electromagnet 37, core 38 and compression spring 39. The housing 40 is fastened to the rear end of the bearing rail 31 and current for the parts accommodated in the housing 40, as well as for the light-sensitive receiver 30, is supplied by a cable 41 having a plug 42 which is connected to the power source line 43 wired along the inside of the machine. This can be a branch line of the already mentioned line 26. The bearing rail 31 with its U-shaped cross-section is adjustable lengthwise and is capable of being locked by means of a clamping bolt 44 in a support bracket 45 integral with a fastening bracket 46 which is fixedly seated on the support rod 7 and fastened to the latter by means of a clamping bolt 47.

A slide 48, adapted to the U-shaped inside cross-section of the bearing rail 31, is inserted into the former. The rear end section of the slide 48, projects into the housing 40, and is provided with a notch 49 which is engaged by a lug at the end of the core 38. The lug serves as a bolt, preventing longitudinal movement of the slide 48 as long as the electromagnet 37 is not excited.

A coupling projection 50 is formed on the forward end of the slide 48. The projection 50 engages a recess formed in a coupling stud 51, integral with a blocking shell 52, rotatably mounted on the axle of the lower roll 1, embracing the circumference of the roll 1 by slightly more than one half. This blocking shell 52 is secured against rotation about or with the lower roll 1 by its coupling with the slide 48. The blocking shell comprises a cylindrical section. The axial length of the blocking shell 52 is such that it extends coextensively with the entire axial length of the upper roll 1'. The rear end of the slide 48 abuts against a compression spring 53, which biases the slide 48 in the forward direction. The slide 48 has a flange at the rear end limiting movement of the slide by its engagement with the wall of the housing 40.

FIG. 1 illustrates the parts in the positions which they assume during full, undisturbed running of the drawing frame. The alternating light intensity signal generated by the rotating ballooning thread 13 is utilized for the modulation of the luminous radiation of the light-emitting diode 23, and the alternating voltage generated as a result by the light-sensitive receiver 30 results in the absence of an initiating pulse for the electromagnet 37. If the finished thread 10' running between the exit 3, 3' of the drawing frame and the cop 12 should break, i.e. if no rotating balloon of thread is present, then no modulated luminous radiation exists and no alternating voltage is supplied to the amplifier and the identification circuit 35. The circuit 35 will then give an actuating pulse in the form of a start-up current surge for the electromagnet 37. The core 38 is then caused to move against the force of the spring 39, disengaging its stud from the notch 49 of the slide 48. The compression spring 53 thereupon acts on the end of the slide 48 and bracing itself against the housing 40, moves the slide 48 toward the front of the drawing frame, (to the left with reference to the drawing). The coupling projection 50 causes the blocking shell 52 to rotate, counter-clockwise in the direction of rotation of the lower roll 1, so that its wedge-shaped longitudinal leading edge penetrates between the slubbing 10 and the lower roll, clamping the leading edge of the slubbing into engagement with and between it on the upper roll 1'. The continued rotation of the blocking shell 52 is prevented by the limited movement of the slide 48. The slubbing 10, which is lifted off the lower roll 1, lies on the outer surface of the blocking shell 52 and also against the upper roll 1' but lifted off the lower roll 1. The slubbing is thus held firm and prevented from further movement but in a position to easily reengage the driven roller when the slide 48 is returned to its operational position. The problems normally caused in the conventional devices by rupture of the end or finished material 10' is thus prevented. Normally, the feed slubbing 10 would continue to be fed to the draw frame through the rotating entry rollers and material would be lost or lap formations would occur. These would be, normally, difficult to eliminate or may even cause damage to the machine by lapping. Since the slubbing 10 is now held out of engagement with the driven roller 1, no such problems occur.

After repair of the cause of disruption, and retying of the thread 10', the parts of the blocking device 36 are moved again into the normally operating position by actuating a handle 54 formed with the coupling stud 51. Movement of the handle 54 to the rear end (right in the drawing) causes the slide 48 to move against the spring 49 into re-engagement with the lug on the solenoid core 38.

It may be expedient in the event of a transitory failure of the modulated radiation 29, to keep the identification circuit 35 from immediately producing the actuating pulse, since it is possible that the failure of the radiation 29 is not caused by a break or other disruption of movement of the end material 10', but by short-term interruptions of the path of rays 29 as a result of manipulations within its area, for instance by cleaning measures or during the respreading or rejoining of previously broken material. In order to prevent this premature actuation, a rectifier with relatively high time constant (thermal or RC-member) and a pulse-shaping circuit may be provided additionally to the identification circuit 35, making it possible to give this actuating pulse only at a predetermined time interval after the stop command. A time lag of 5 seconds, within which the voltage present in the circuit has fallen to the threshold value decisive for the delivery of the actuating pulse would seem sufficient. This short-term time delay for the reaction of the blocking device 36 is immaterial should there be an actual disruption in the material 10', because in such a short time the continued run of the starting material 10 will not yet lead to lapping or another disturbance.

The device described is especially suited for division into the two structural groups, i.e. sensor assembly 14 and the identification circuit 35 together with the blocking device 36, for subsequent attachment to a machine already in place. It is merely necessary to install the two power lines 26 and 43 with the associated sockets for the plugs 25 and 42, respectively along the machine. The structural sensor assembly which forms one structural unit, can be easily assembled. The blocking shell 52 can as easily be placed on the lower roll 1, and its mechanical actuating device can be mounted on the support rod 7. The parts delivering the electrical actuating pulse and the light-sensitive receiver the other structural group can be mounted, without intervention to the existing construction of the machine so as to retrofit the machine. The essential advantage is that the two structural groups are functionally connected with each other without special mechanical coupling or wiring, i.e. only by the modulated luminous path of radiation beam 29.

Figure 2:
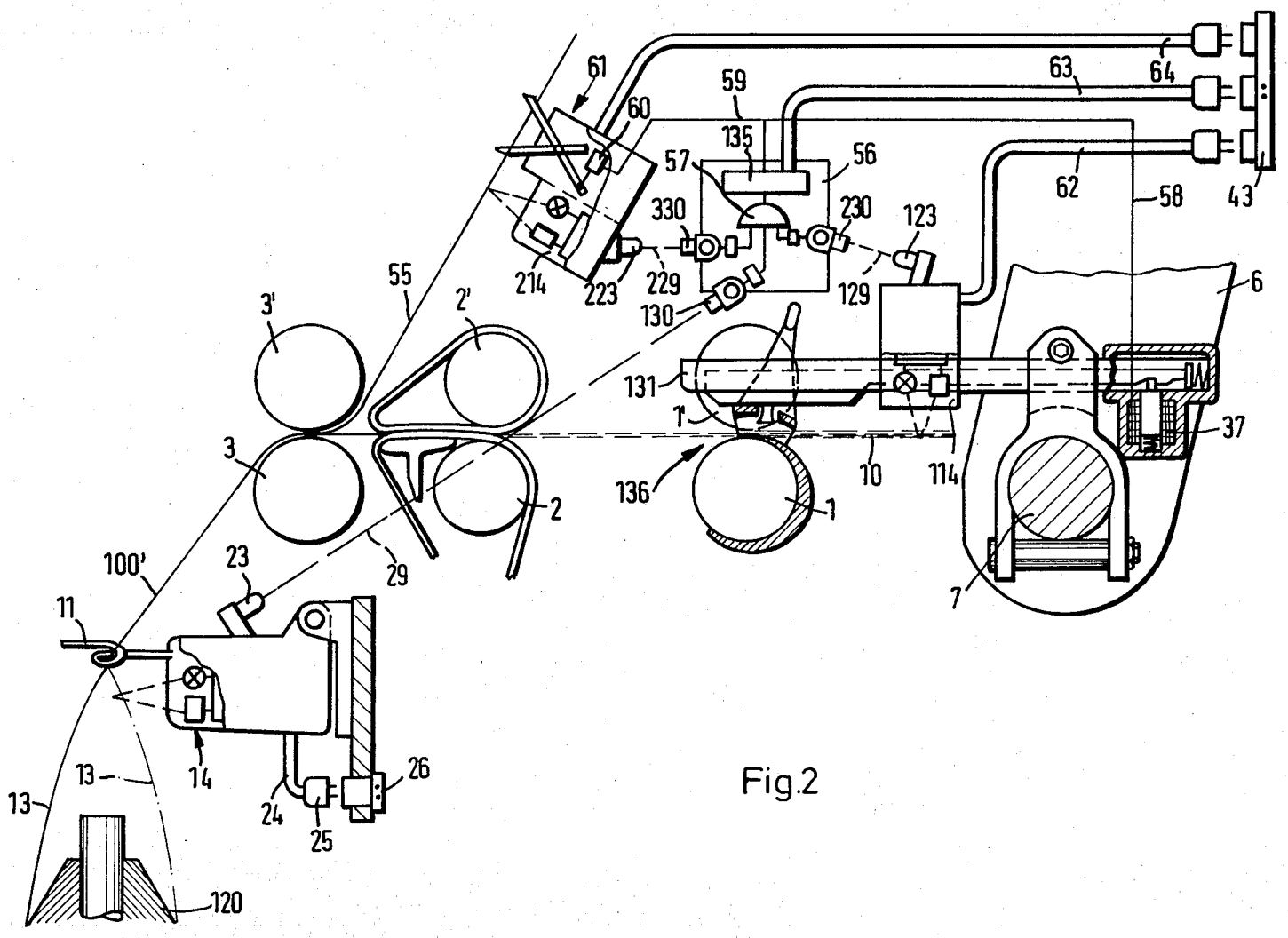
FIG. 2 is a view similar to FIG. 1 showing a drawing frame, adapted for the processing of multiple yarns, employing the present invention.

In the example according to FIG. 2, the invention is easily applied on machines which draw more than one starting material. Although in this case a sensor assembly and receiver assembly are provided for each material, separating devices are provided for each of the starting materials. The essential advantages of the invention, namely the low assembly expenditures and the ability of subsequently equipping machines of different design remain intact.

FIG. 2 shows a spinning or drawing frame for the manufacture of a so-called core yarn, that is a yarn in which a continuous filament is covered with staple fibers. One starting material consists therefore of staple fibers entering the draw frame as a slubbing 10 in the manner shown in FIG. 1. For the sake of simplification only the lower and upper rolls 1, 2, 3 and 1', 2', 3', respectively are shown. In addition, a partial illustration of the support bracket 6 and the rod 7 are shown. The blocking device explained with respect to FIG. 1 is the same and is identified here by numeral 136. The other starting material is a continuous filament 55 which is delivered to the drawing frame in advance of the final rolls 3, 3' and is combined there with the stretched slubbing 10 to form the end material 100', the latter passing through the yarn guide 11, which together with the sensor assembly 14, is structured and works as already described with respect to FIG. 1; its light-emitting diode 23 being aligned so that the radiation beam 29 modulated by the running balloon of thread 13 hits a light-sensitive receiver 130, held in a housing 56 by a pivot or ball joint bearing. The housing 56 holds as well, in equally adjustable manner, still other photo receivers 230 and 330. The receiver 230 is associated with a light source or diode 123 mounted on the pivotal blocking rail 131. The light beam 129 from this source is in response to a sensor assembly 114, sensing the movement of the slubbing 10 into the rollers 1 and 1'. The sensor assembly 114 acts in principle in the same manner as the sensor assembly 14 illustrated in FIG. 1 so that luminous radiation directed to the slubbing 10 results in a reflected alternating light intensity signal when the slubbing is in motion. This signal is received by the light-sensitive cell of the sensor assembly 114 and causes the production of the modulation for the radiation beam 129. The receiver 330 is associated with a light source (diode) 223 mounted on a housing 61 on which a sensor assembly 214 is located, to monitor the continuous filament 55. In this case too, the movement of the filament 55 is reflected and an alternating light intensity signal is received by the photocell 330 caused by a modulated beam 229.

The alternating currents deliverd by the photo cells 130, 230, and 330 are combined in one place, namely in the collective housing 56 and are delivered near an amplifier to an AND-operator 57 and from the latter to an identification circuit 135 which works like the identification circuit 35 previously described with respect to FIG. 1 from which is delivered a switching pulse when any one of the modulated radiations 29, 129, or 229 is absent. The AND-operator 57 and the identification circuit 135 are both accommodated in the collective housing 56. The identification circuit 135 is connected by a first cable 58 with the electromagnet 37 of the blocking device 136, and by a second cable 59 to a second electromagnet 60 which actuates when excited a separating device 61 (scissor) by which the filament 55 is cut. When a disruption of movement of the material assigned to any one of the sensors 14, 114, or 214 is detected by one of the latter and its modulated radiation is absent, the identification circuit 135 generates the start-up surge for both the magnets 37 and 60. This serves to actuate simultaneously the blocking device 136 and the separating device 61, resulting in a disruption of the feed of both starting materials 10 and 55 to the drawing frame. The circuit already mentioned above by which a delay in the delivery of the start-up current surge for the electromagnets 37 and 60 when one of the modulated radiations fails, can be included in the identification circuit 135.

The sensor assembly 14 is connected in the manner already described above by the cable 24 and plug 25 with the power line 26 wired on the machine, and the electrical components of the sensor assemblies 114 and 214 and of the housing 56 are connected in the same way with the additional power feed line 43 by means of the respective cables 62, 64 and 63. The fastening of the housing 56 on the machine does not present any substantial problem even in retrofit because the adjustability of the light-emitting diodes and the light-sensitive receivers provides numerous possibilities for the mutual connection of the structural groups with input to the paths of radiation 29, 129 and 229, in line-of-sight spaced from the mechanical components of the drawing frame. The housing containing the sensor assembly 114 can, for example, be placed on the bearing rail 131 to the side of the blocking device 136. On the other hand, the sensor assembly 214 does not, as shown in the drawing, have to be structurally combined with the separating device 61. It is preferable, however, that the modulated radiations beams emitted from the light-emitting diodes of the individual sensor assemblies be guided to a common structural group and that this structural group (collective housing 56) contains also the sole circuit delivering the actuating pulse for the blocking or separating devices assigned to the individual materials.

The device shown in FIG. 2 is especially suited, because of its simple structure, for use with machines in which also more than two starting materials are processed to an end material, for instance twisting machines, in which a twisted yarn is manufactured from three feed materials. Each of the three feed materials is then assigned a sensor assembly and a separating device, and a sensor is also directed to the manufactured twisted yarn. The alternating currents generated from the modulated radiations of all sensors are then fed to the common AND-operator and identification circuit and the latter delivers the actuating pulses to the three separating devices connected with it in the event of failure of any one of the four modulated radiations.

One of the cable connections between the identification circuit 135 and the electomagnets 37 and 60 respectively illustrated in FIG. 2 can, if need be, be dispensed with if the collective housing 56 and the housing containing one of the magnets are structurally combined, as by mounting the cutting device 60 on the housing 56.

Figure 3:
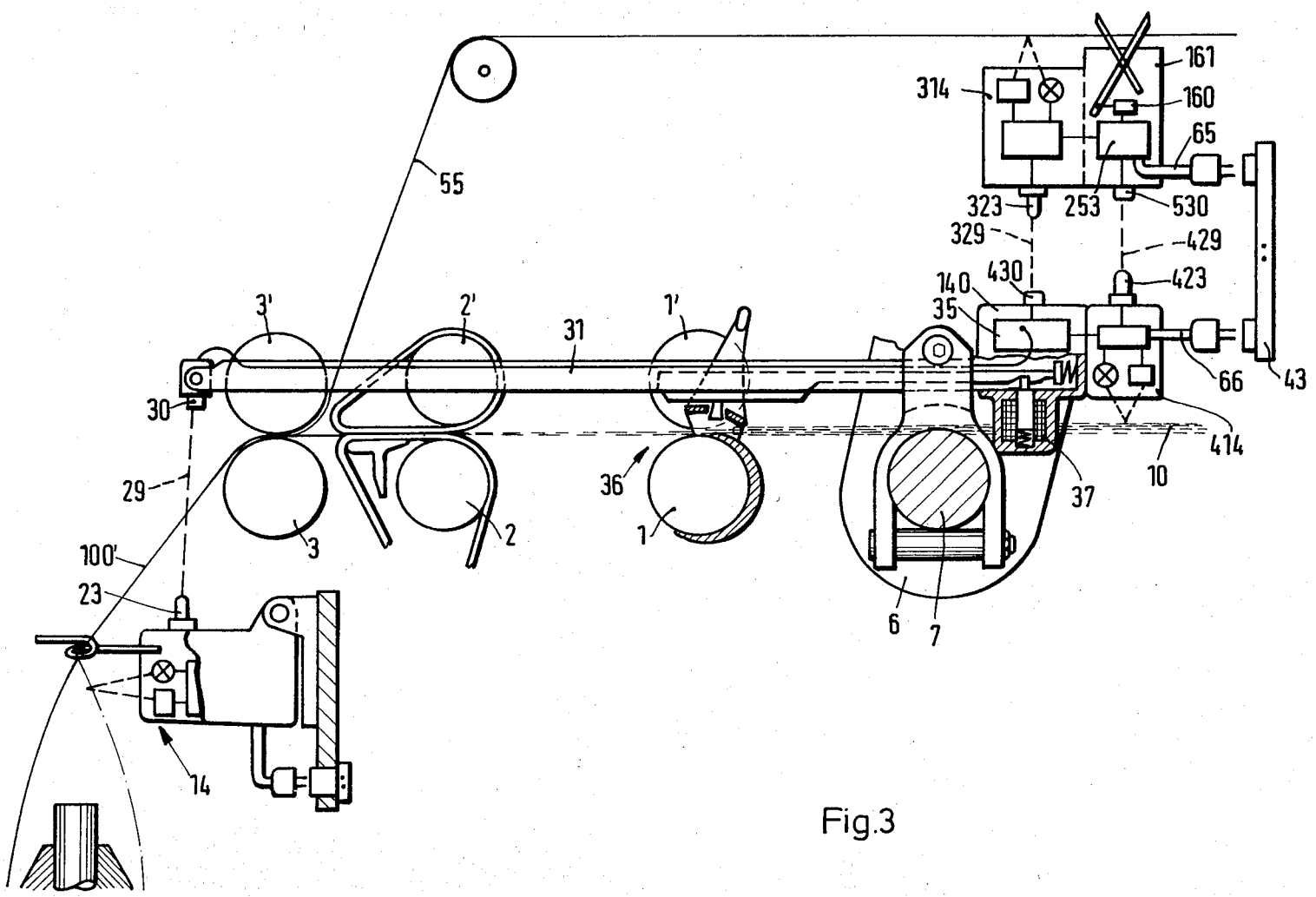
FIG. 3 is a view similar to FIG. 2, showing the present invention employed on a drawing frame processing two materials.
Figure 4:
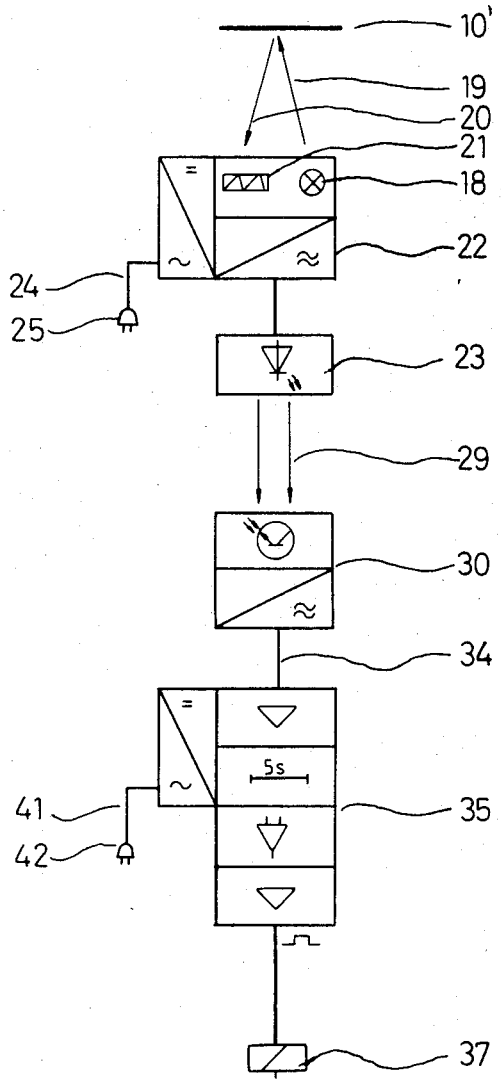
FIG. 4 is a circuit diagram of the operating means employed in the apparatus of FIG. 1.
Figure 5:
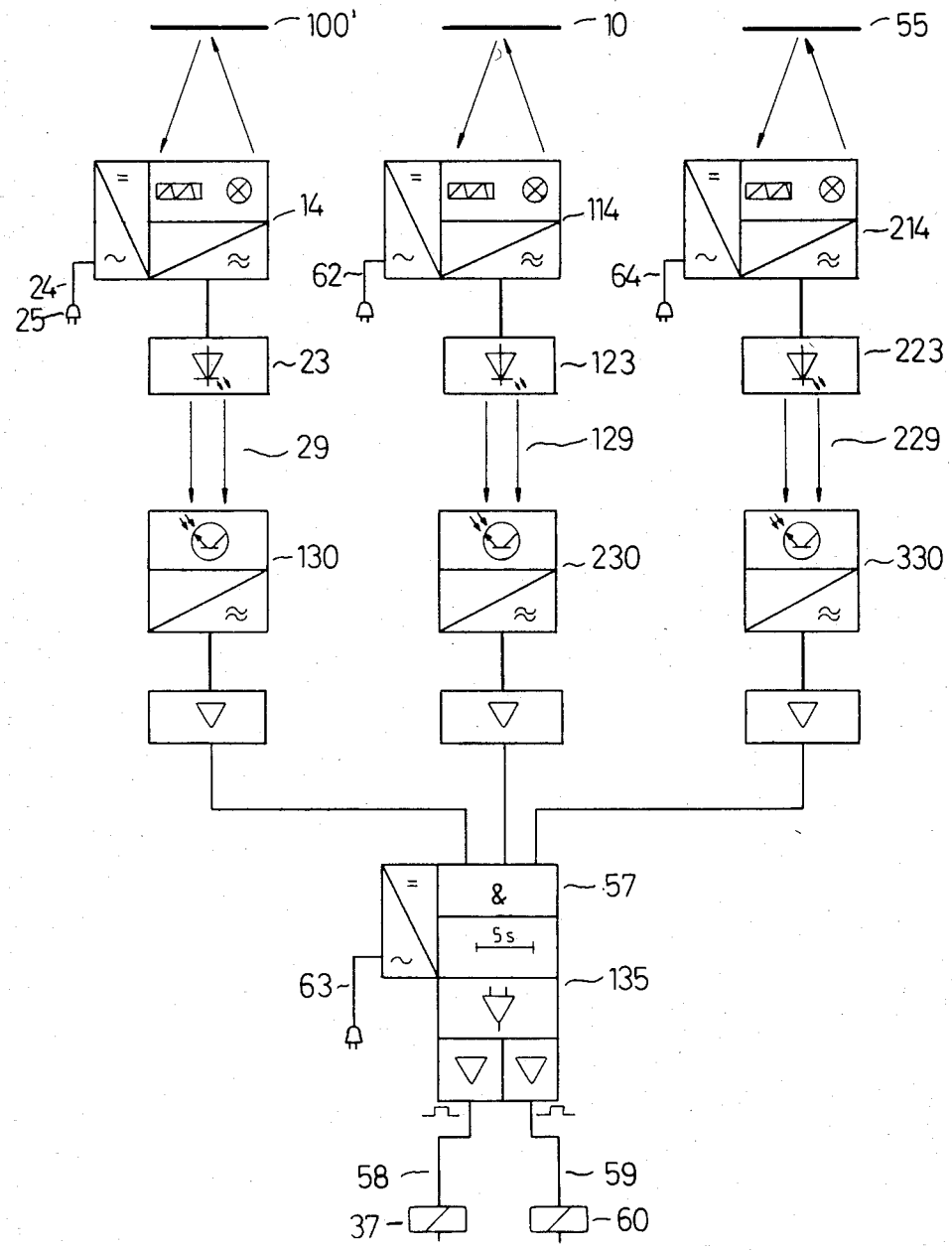
FIG. 5 is a circuit diagram of the operating means employed in the apparatus of FIG. 2; and, FIG. 6 is a circuit diagram of the operating means employed in the apparatus of FIG. 3.
Figure 6:
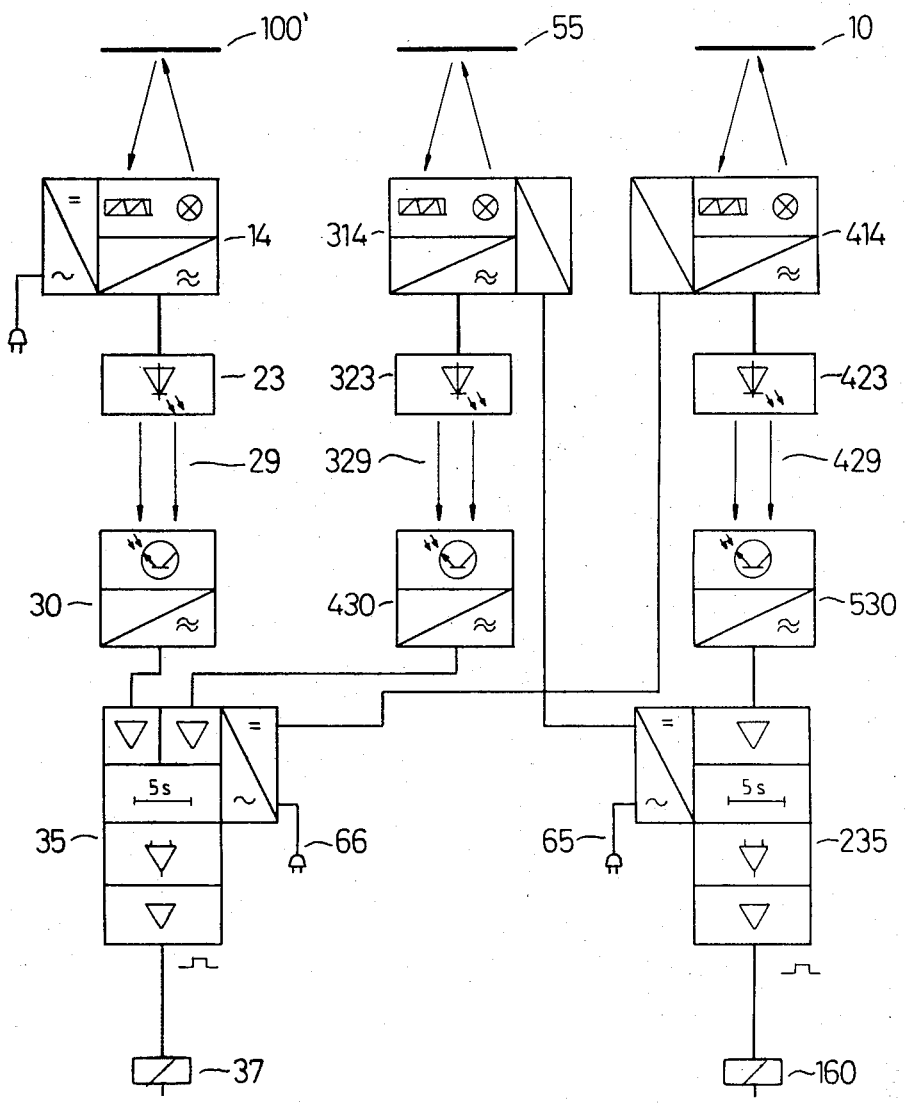

The arrangement shown in FIG. 3 is particularly suited for use with machines producing one end material from two starting materials. In this case, a sensor assembly and a blocking or separating device are assigned to each starting material, the former acting to cross-switching the latter mutually if there is a disruption of the movement of the starting materials, without the existence of a mechanical or cable connection between them.

Although this arrangement can also be employed with machines serving other production purposes, it is again explained in connection with a drawing frame.

FIG. 3 shows only the lower and upper rolls 1, 2, 3, and, respectively, 1', 2', 3', a part of the support bracket 6, and the rod 7 of the drawing frame illustrated in FIGS. 1 or 2. The feed slubbing 10, the sensor assembly 14, and the blocking assembly correspond to those described in FIG. 1. The modulated radiation beam 29 emitted from the light-emitting diode 23 of the sensor assembly 14 acts as shown in FIG. 1, so that the light-sensitive receiver 30 mounted to the bearing rail 31 feeds a pulse signal to the electromagnet 377. The identification circuit 35 is arranged in a housing 140 at the rear end of the bearing rail 31. In the event of trouble with the movement of the end material 100' detected by the sensor assembly 14, this blocking device 36 works in the same manner as is described with the aid of FIG. 1.

As a second starting material, a continuous filament 55 is again fed, as in the example pursuant to FIG. 2, to the site between the pair of rolls 3, 3'. A sensor assembly 314 and a separating device 161 are assigned to this continuous filament 55, preferably combined in one structural group and connected by a cable 65 with the power feed line 43 wired to the machine. A housing containing an additional sensor assembly 414 is joined to the housing 140 and this sensor assembly 414 monitors the slubbing 10 running into the draw frame. The power supply of this sensor assembly 414 and of the electrical components of the blocking device 36 is provided by cable 66 which is connected with the current feed line 43. The modulated radiation 329 originating with the flawless running of the continuous filament 55, from the light-emitting diode 323, is directed to a light-sensitive receiver 430 arranged on the housing 140 which, as the receiver 30, is connected with the identification circuit 35. The modulated radiation 429 emitted with the flawless running of the slubbing 10 from the light-emitting diode 423 of the guard 414 is received by a light-sensitive receiver 530 mounted on the housing of the separating device 161. The thereby generated alternating currents are fed to an identification circuit 235 which is structured the same way as the already described identification circuit 35 and works like the latter, delivering therefore in the absence of the modulated radiation 429 an actuating pulse which excites in this case the electromagnet 160 switching the separating device 161.

The device described consists of three structural groups, and can therefore be easily retrofitted to an existing machine to work in the following manner:

If disruption of the movement of the slubbing 10 (break of the slubbing, end of the run-in of the slubbing) first occurs, it is detected by the sensor assembly 414, resulting in an absence of a modulated radiation beam 429 originating from its light-emitting diode 423. Consequently, the identification circuit 235 delivers therefrom, because no alternating current arrives from the light-sensitive receiver 530, an actuating pulse to the electromagnet 160 for the separating device 161, which severs the thread 55. Thereupon, the sensor assembly 314 detects the absence of the filament 55 and the resultant absence of a modulated radiation beam 329 causes an actuating pulse delivered by the identification circuit 35 for the electromagnet 37 and thus for the blocking device 36. The remainder of the filament 55 and the unblocked part of the slubbing 10 are still processed to the end material 100' which, as already described with regard to FIG. 2, is a core yarn.

If first, a disruption (yarn break, end of the feed thread) occurs in the run of the other starting material, namely the filament 55, it is recognized by the sensor assembly 314, resulting in the omission of the modulated radiation 329 originating from its light-emitting diode and leading, because the alternating current is no longer delivered by the light-sensitive receiver 430, to an actuating pulse delivered by the identification circuit 35 for the blocking device 36 which prevents the continued movement of the slubbing 10. This is registered by the sensor assembly 414 as a steady or unvaried reflection resulting in the absence of a modulated radiation 429. This causes an actuating pulse to be delivered for the separation device 161, originating from the identification circuit 235. This pulse is superfluous since the filament 55 is by now fully absent. In this case, too, the forward portion of the filament 55 and the unblocked part of the slubbing 10 are still processed to an end material 100'.

Due to this cross-switch, the continued run of the one starting material is prevented by being blocked or separated in the event of a disruption of the movement of the other starting material, making the production of a faulty end material 100' impossible.

If a disruption, for instance a break, occurs first in the run of the finished material 100', this will be detected by the sensor assembly 14 whose modulated radiation 29 is then omitted. As already described with respect to FIG. 1, this will cause the delivery of an actuating pulse by the identification circuit 35 for the blocking device 36. The movement of the slubbing 10 will then be arrested. The sensor assembly 414 assigned to the slubbing recognizes this stoppage, and its then omitted modulated radiation 429 causes, as already described, actuation of the separating device 161 which cuts the filament 55. The sensor assembly 314 recognizes this separation and by omission of its modulated radiation 329, a signal is issued for switching the blocking device 36. This signal is superfluous since the device 36 is already in the blocking position. The continued run of the two starting materials 10 and 55 is thus disrupted by their blockage or separation although the remnants of the slubbing 10 and the thread 55 still exit from the drawing frame due to the further rotating of the delivery rolls 3, 3', without lapping or another hindrance.

The sensor assemblies 314, 414 with the blocking or separating device described with reference to FIG. 3 and connected only with each other by their radiation paths 329, 429, transmitting to each other stop commands and associated with each other in pairs, can be used without any problem also on other spinning devices than the one illustrated in FIG. 3. Their employment is especially suited in connection with a Finisher-Bobbin the two slubbings of which should run simultaneously from the bobbin to one spinning position each. If each of these two adjacent spinning positions is equipped with a sensor assembly 414 and the blocking device 36 for the slubbings as illustrated in FIG. 1, and if in addition, as explained with reference to FIG. 3 regarding the filament 55, the spinning positions associated in pairs by the common Finisher-Bobbin are provided additionally with a sensor assembly assigned to the slubbing, with its light-emitting diode directed towards the light-sensitive receiver located at the other blocking device and causing the identification circuit to deliver the actuating pulse for this blocking device when the modulated radiation is not received, it is assured both in the event of a ruptured slubbing at one of the spinning positions, that the blocking device 36 of this spinning position and also the blocking device 36 of the associated other spinning position which is not affected by a disruption of the movement of the material itself, are switched to the blocking position. The slubbing will therefore run off the Finisher-Bobbin only if both spinning positions operate at the same time without interruption.

The light-emitting diode 323, 423 and the light-sensitive receivers 430 and 530, like the respective parts of the device illustrated in FIGS. 1 and 2, can also be arranged on pivot bearings or ball joint mountings, as to make it possible to align them with each other also in other than the mutual alignment illustrated.

The arrangement shown in FIG. 1 is, however, also suited for use at a spinning position supplied by a Finisher-Bobbin if its electromagnet is thereby connected additionally to the identification circuit 35 of the adjacent spinning position served by the same Finisher-Bobbin. Such a connection, by short cable which passes the stationary support 6, can be established simply without any particular problems. Each actuating pulse delivered by one of the two identification circuits in the event of a disruption at their spinning position will then affect also the circuit of the adjacent blocking device 36 so that with the stoppage of the running of the slubbing to one spinning position the run of the slubbing to the other spinning position is also stopped.

The process and device pursuant to the invention are suited to be supplemented by a device or devices capable of determining and identifying the exact nature and position of the disruption in the movement of the material. An electrically or a mechanically switched indicia device can be used for this purpose, for instance a lamp indicating by visual signal the position of disruption. Indicia signals can be derived directly from the existing electrical circuits or from the moving parts of the blocking or separating device. It is also possible to register the number of disruptions occurring at a given spinning position by use of a counting device assigned to the respective sensors or blocking or separating devices, thereby being able in the case of excessive frequency of disruptions to check the particular drawing frame for damaged, faulty or non-functioning components which might cause the disruption of the movement of the material. The number of disruptions may, however, be transmitted to and evaluated by a data collection unit or computer assigned to the machine, to which, if required, several machines are connected.

Various embodiments, modifications and changes have been mentioned here, other such variations will be obvious to those skilled in this art. Accordingly, the present disclosure is to be taken as illustrative and not as limiting of the present invention.

What is claimed is:

1. Apparatus for regulating the passage of moving material through a textile spinning machine or the like comprising a first assembly having means operable for controlling the entry of said material into said machine, a second assembly located downstream from said first assembly for determining the continuity of said material moving through said machine comprising means for impinging a light source on said material, means for sensing the light reflected from said moving material and for converting said reflected light into an electrical signal of alternating intensity, means for modulating said alternating intensity electrical signal, and light emitting means responsive to said modulated alternating intensity electrical signal for emitting a modulated light beam, and a third assembly for producing a command signal for operating said control means comprising a receiver for said modulated light beam spaced remotely from and arranged in line of sight with said light emitting means providing an electrical output and means for converting said electrical output into an alternating voltage comprising an amplifier receiving the output of said receiver, and an identification circuit responsive to said amplifier for rectifying the output signal and a pulse generator providing a pulse for operating said means for controlling the entry of said material.

2. The apparatus according to claim 1 wherein said means for controlling the entry of said material includes means for arresting the movement of said material fed into said machine or separating the material fed to said machine from the source of said material.

3. The apparatus according to claim 1 wherein the material is spun into a thread and the machine includes a thread guide located to place said thread on a bobbin and means for winding said thread on the bobbin, said means for sensing the light reflected from said material being located to intercept the light reflected from the thread as it is wound on said bobbin.

4. The apparatus according to claim 1 wherein said means for emitting the modulated light beam and the receiver of said beams are respectively pivotally mounted on said machine so that their position is adjustable whereby they are positionable in direct line of sight spaced from each other.

5. In a machine processing two or more starting materials into a single end material including the apparatus of claim 1 applied in association with at least two of said starting materials and said end material including means for controlling entry of each of said starting materials, means for sensing the light reflected from each of said moving material and associated emitters, receivers and means for connecting said to output thereof into an electrical signal.

6. In the machine according to claim 5, wherein the receivers for the modulated light beams of two or more emitters are connected to a common amplifier via an AND gate for operating each means for controlling entry of the material simultaneously.

7. In the machine according to claim 5, wherein each of the receivers for said modulated light beam derived from a given one of the materials is connected respectively to at least one of the amplifiers associated with at least one other material whereby the sensed material controls the movement of said other material.

8. The apparatus according to any one of claims 1–7, wherein the means for sensing the light reflected from the material, the modulating means and light emitter are combined into a first structural group and the receiver of the modulated light beam, the amplifier and identification circuits are combined into a second structural group, separated from said first structural group.

9. The apparatus according to claim 8 in combination with the draw frame of a ring spinning machine having a carrier for the yarn guide, arranged coaxially with a spindle and having a slubbing blocking device provided on a draw frame and switchable in case of yarn break, wherein the first structural group is mounted in association with the carrier of the yarn guide, and the second structural group is arranged in association with the slubbing blocking device provided on the draw frame.

10. The apparatus according to claim 9 including a light source directed onto the thread and a photo cell for sensing the reflected portion arranged to sense the thread after its passage through the yarn guide.

11. The apparatus according to claim 9 wherein the draw frame includes paired upper and lower rolls and the slubbing blocking device is mounted on a bearing rail arranged alongside the upper rolls of the draw frame, and includes an electro-magnet mounted on said bearing rail, responsive to said command pulse to operate said blocking device said second structural group being arranged on said bearing rail.

12. The apparatus according to claim 11, wherein the receiver for the modulated light beam is mounted at the forward end of the bearing rail and the electro-magnet and second structural group are mounted at the rear end of the bearing rail.

13. The apparatus according to claim 1, including means for delaying the pulse operating said means for controlling the entry of said material for a predetermined interval.

* * * * *